US010932348B2

(12) United States Patent
Peng

(10) Patent No.: US 10,932,348 B2
(45) Date of Patent: Feb. 23, 2021

(54) LIGHT EMITTING DIODE LAMP UTILIZING RADIO FREQUENCY IDENTIFICATION SIGNAL AND SYSTEM FOR THE SAME AND ADDRESS BURNING METHOD FOR THE SAME

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 155 days.

(21) Appl. No.: 16/126,535

(22) Filed: Sep. 10, 2018

(65) Prior Publication Data

US 2020/0084859 A1 Mar. 12, 2020

(51) Int. Cl.
*H05B 47/19* (2020.01)
*H05B 45/00* (2020.01)
*H05B 45/37* (2020.01)

(52) U.S. Cl.
CPC ..... *H05B 47/19* (2020.01); *H05B 45/00* (2020.01); *H05B 45/37* (2020.01)

(58) Field of Classification Search
CPC ..... H05B 47/19
See application file for complete search history.

(56) References Cited

U.S. PATENT DOCUMENTS

2008/0041930 A1* 2/2008 Smith ..... G06F 9/44505 235/375
2010/0213876 A1* 8/2010 Adamson ..... H05B 47/19 315/312
2016/0119277 A1* 4/2016 Peng ..... H05B 45/10 315/185 R
2016/0165702 A1* 6/2016 Lai ..... H05B 45/22 315/201
2017/0238397 A1* 8/2017 Green ..... H05B 45/37 315/129

* cited by examiner

*Primary Examiner* — Alexander H Taningco
*Assistant Examiner* — Pedro C Fernandez
(74) *Attorney, Agent, or Firm* — Chun-Ming Shih; HDLS IPR Services

(57) ABSTRACT

A light emitting diode lamp includes a light emitting diode driving apparatus and at least one light emitting diode. The light emitting diode driving apparatus includes a radio frequency identification tag, an address burning controller, an address memory and a light emitting diode driving circuit. The radio frequency identification tag wirelessly receives a radio frequency identification signal. The radio frequency identification tag converts the radio frequency identification signal into a local address signal. The radio frequency identification tag sends the local address signal to the address burning controller. The address burning controller converts the local address signal into a local address data. The address burning controller burns the local address data into the address memory so the address memory stores the local address data.

9 Claims, 7 Drawing Sheets

LIGHT EMITTING DIODE LAMP UTILIZING RADIO FREQUENCY IDENTIFICATION SIGNAL AND SYSTEM FOR THE SAME AND ADDRESS BURNING METHOD FOR THE SAME

BACKGROUND OF THE INVENTION

Field of the Invention

The present invention relates to a light emitting diode lamp, a light emitting diode system and a light emitting diode address burning method, and especially relates to a light emitting diode lamp utilizing a radio frequency identification signal, a light emitting diode system utilizing the radio frequency identification signal and a light emitting diode address burning method utilizing the radio frequency identification signal.

Description of the Related Art

Currently, there are two types of the related art light emitting diode lamps: the serial-type light emitting diode lamp and the parallel-type light emitting diode lamp. Both the serial-type light emitting diode lamp and the parallel-type light emitting diode lamp need to use a plurality of power transmission lines and signal transmission lines, which waste wires. Afterwards, the related art technology which transmits the lighting signal through the power transmission lines is provided to save the signal transmission lines, wherein the lighting signal comprises the lighting data and the address data.

The local address data has to be burned into the light emitting diode driving apparatus when the light emitting diode driving apparatus is manufactured. The light emitting diode driving apparatus checks whether the address data of the lighting signal is the same with the local address data or not when the light emitting diode driving apparatus receives the lighting signal mentioned above. The light emitting diode driving apparatus drives the light emitting diode to light according to the lighting data of the lighting signal if the address data of the lighting signal is the same with the local address data of the light emitting diode driving apparatus.

However, the disadvantage of the method mentioned above is that once the light emitting diode driving apparatus has been manufactured, the local address data cannot be changed. Therefore, it is very inconvenient for the warehouse management. Moreover, it is also very inconvenient for assembling a lot of the light emitting diode driving apparatuses because the operator has to check the local address data of every light emitting diode driving apparatus carefully to avoid assembling the incorrect light emitting diode driving apparatus.

SUMMARY OF THE INVENTION

In order to solve the above-mentioned problems, a first object of the present invention is to provide a light emitting diode lamp utilizing a radio frequency identification signal.

In order to solve the above-mentioned problems, a second object of the present invention is to provide a light emitting diode system utilizing the radio frequency identification signal.

In order to solve the above-mentioned problems, a third object of the present invention is to provide a light emitting diode address burning method utilizing the radio frequency identification signal.

In order to achieve the first object of the present invention mentioned above, the light emitting diode lamp of the present invention comprises a light emitting diode driving apparatus and at least one light emitting diode. The at least one light emitting diode is electrically connected to the light emitting diode driving apparatus. Moreover, the light emitting diode driving apparatus comprises a radio frequency identification tag, an address burning controller, an address memory and a light emitting diode driving circuit. The address burning controller is electrically connected to the radio frequency identification tag. The address memory is electrically connected to the address burning controller. The light emitting diode driving circuit is electrically connected to the at least one light emitting diode and the address burning controller. Moreover, the radio frequency identification tag is configured to wirelessly receive a radio frequency identification signal. The radio frequency identification tag is configured to convert the radio frequency identification signal into a local address signal. The radio frequency identification tag is configured to send the local address signal to the address burning controller. The address burning controller is configured to convert the local address signal into a local address data. The address burning controller is configured to burn the local address data into the address memory so the address memory is configured to store the local address data.

In order to achieve the second object of the present invention mentioned above, the light emitting diode system of the present invention comprises a light emitting diode lamp and a radio frequency identification reader/writer. The radio frequency identification reader/writer is wirelessly connected to the light emitting diode lamp. Moreover, the light emitting diode lamp comprises a light emitting diode driving apparatus and at least one light emitting diode. The at least one light emitting diode is electrically connected to the light emitting diode driving apparatus. Moreover, the light emitting diode driving apparatus comprises a radio frequency identification tag, an address burning controller, an address memory and a light emitting diode driving circuit. The address burning controller is electrically connected to the radio frequency identification tag. The address memory is electrically connected to the address burning controller. The light emitting diode driving circuit is electrically connected to the at least one light emitting diode and the address burning controller. Moreover, the radio frequency identification tag is configured to wirelessly receive a radio frequency identification signal. The radio frequency identification tag is configured to convert the radio frequency identification signal into a local address signal. The radio frequency identification tag is configured to send the local address signal to the address burning controller. The address burning controller is configured to convert the local address signal into a local address data. The address burning controller is configured to burn the local address data into the address memory so the address memory is configured to store the local address data. Moreover, the radio frequency identification reader/writer is configured to wirelessly send the radio frequency identification signal to the radio frequency identification tag.

In order to achieve the third object of the present invention mentioned above, the light emitting diode address burning method of the present invention comprises following steps. A radio frequency identification reader/writer wirelessly sends a radio frequency identification signal to a radio frequency identification tag. The radio frequency identification tag converts the radio frequency identification signal into a local address signal. The radio frequency identification tag sends the local address signal to an address burning controller. The address burning controller converts the local address signal into a local address data. The address burning controller burns the local address data into a light emitting diode address memory so the light emitting diode address memory stores the local address data.

The advantage of the present invention is to utilize the radio frequency identification technology to easily burn the local address data into the light emitting diode driving apparatus which had been manufactured to store or change the local address data of the light emitting diode driving apparatus.

Please refer to the detailed descriptions and figures of the present invention mentioned below for further understanding the technology, method and effect of the present invention. The figures are only for references and descriptions, and the present invention is not limited by the figures.

DETAILED DESCRIPTION OF THE INVENTION

Figure 1:
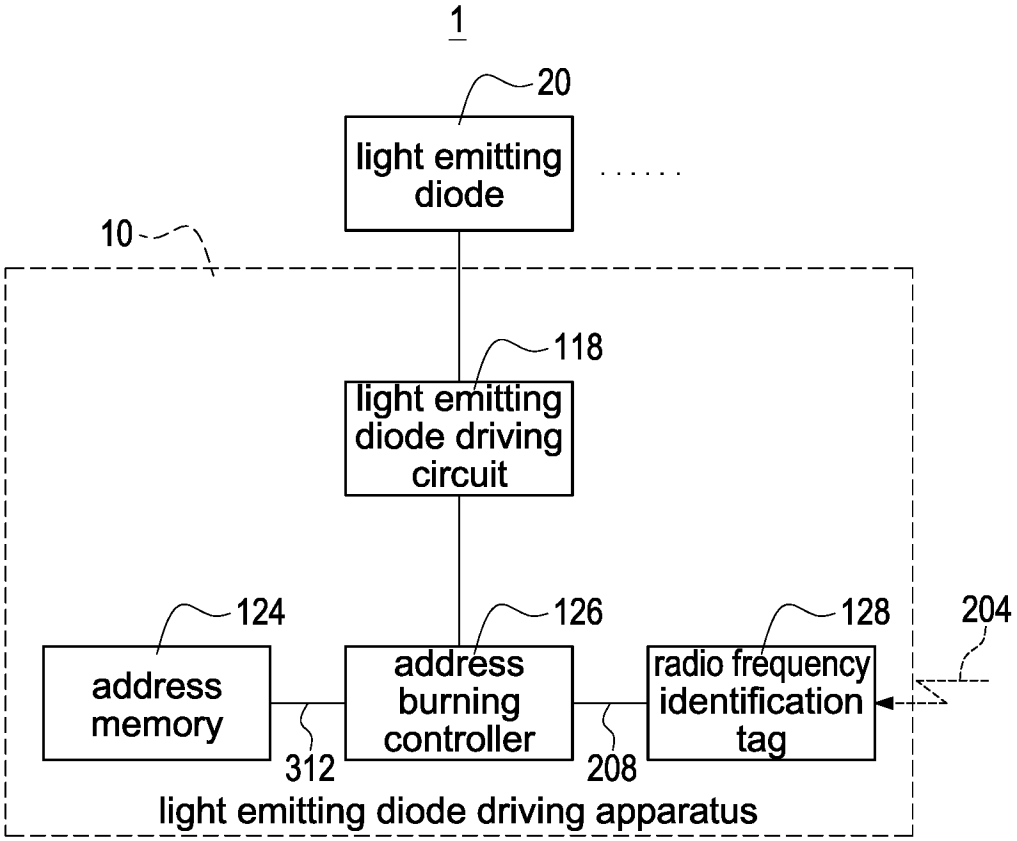
FIG. 1 shows a block diagram of the first embodiment of the light emitting diode lamp utilizing the radio frequency identification signal of the present invention.

In the present disclosure, numerous specific details are provided, to provide a thorough understanding of embodiments of the invention. Persons of ordinary skill in the art will recognize, however, that the present invention can be practiced without one or more of the specific details. In other instances, well-known details are not shown or described to avoid obscuring aspects of the present invention. Please refer to following detailed description and figures for the technical content of the present invention:

FIG. 1 shows a block diagram of the first embodiment of the light emitting diode lamp utilizing the radio frequency identification signal of the present invention. A light emitting diode lamp 1 of the present invention comprises a light emitting diode driving apparatus 10 and at least one light emitting diode 20. The light emitting diode driving apparatus 10 comprises a radio frequency identification tag 128, an address burning controller 126, an address memory 124 and a light emitting diode driving circuit 118. The at least one light emitting diode 20 is electrically connected to the light emitting diode driving apparatus 10. The address burning controller 126 is electrically connected to the radio frequency identification tag 128. The address memory 124 is electrically connected to the address burning controller 126. The light emitting diode driving circuit 118 is electrically connected to the at least one light emitting diode 20 and the address burning controller 126. Moreover, in an embodiment of the present invention, the light emitting diode driving apparatus 10 and the at least one light emitting diode 20 are packaged together to become the light emitting diode lamp 1.

The radio frequency identification tag 128 is configured to wirelessly receive a radio frequency identification signal 204. The radio frequency identification tag 128 is configured to convert the radio frequency identification signal 204 into a local address signal 208. The radio frequency identification tag 128 is configured to send the local address signal 208 to the address burning controller 126. The address burning controller 126 is configured to convert the local address signal 208 into a local address data 312. The address burning controller 126 is configured to burn the local address data 312 into the address memory 124 so the address memory 124 is configured to store the local address data 312.

Figure 5:
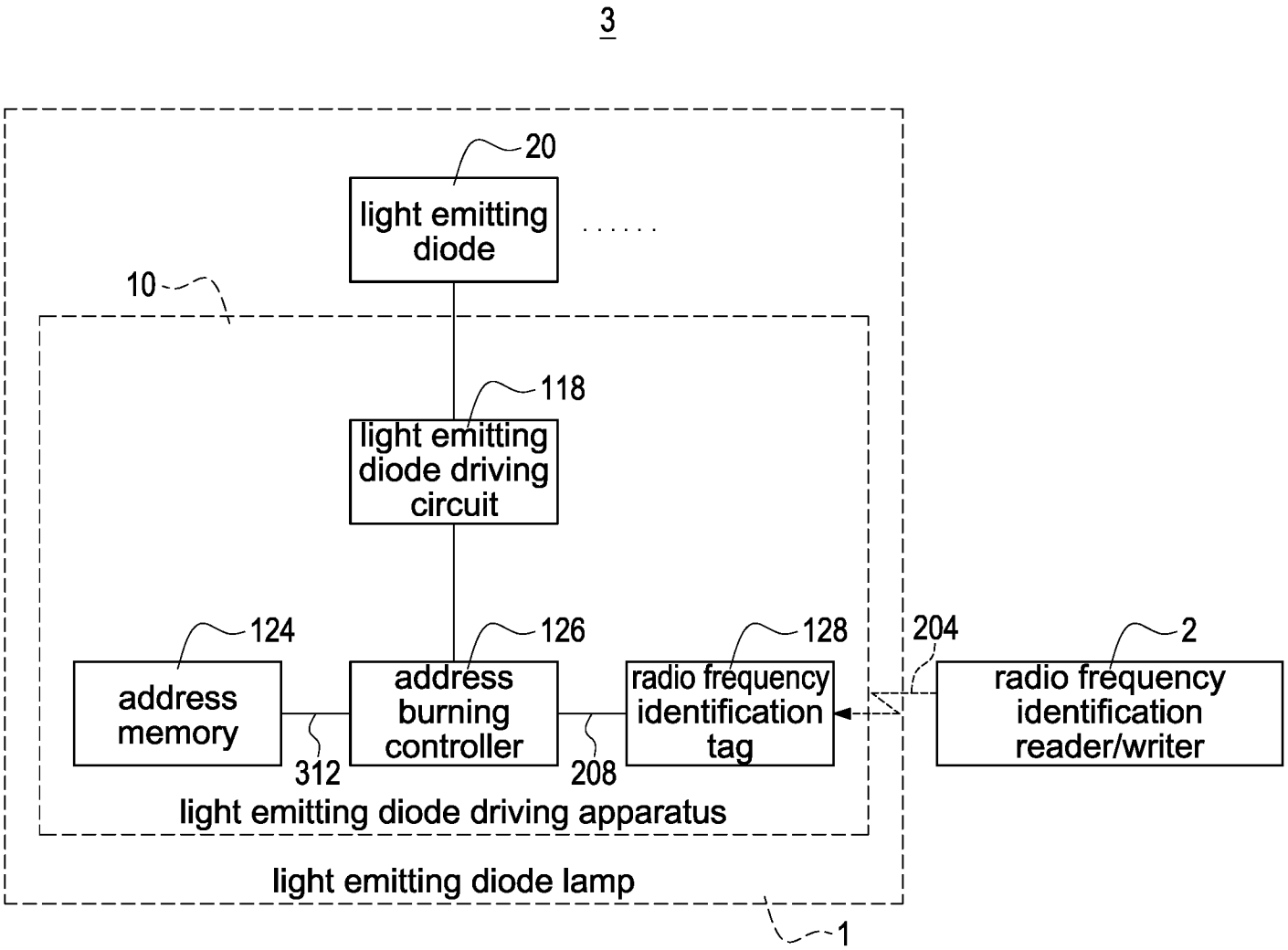
FIG. 5 shows a block diagram of the first embodiment of the light emitting diode system utilizing the radio frequency identification signal of the present invention.

In an embodiment of the present invention, a radio frequency identification reader/writer 2 shown in FIG. 5 is close to the radio frequency identification tag 128 so the radio frequency identification tag 128 automatically induces the radio frequency identification signal 204. The radio frequency identification reader/writer 2 sets the local address data 312 in the radio frequency identification signal 204 so that the radio frequency identification tag 128 converts the radio frequency identification signal 204 into the local address signal 208, and then the address burning controller 126 converts the local address signal 208 into the local address data 312.

The radio frequency identification tag 128 is a passive radio frequency identification tag. The address memory 124 can be a one-time programmable memory or a multiple-time programmable memory, such as an e-fuse memory, an erasable programmable read only memory (ERPOM), an electrically erasable programmable read only memory (EEPROM) or a flash memory.

Figure 2:
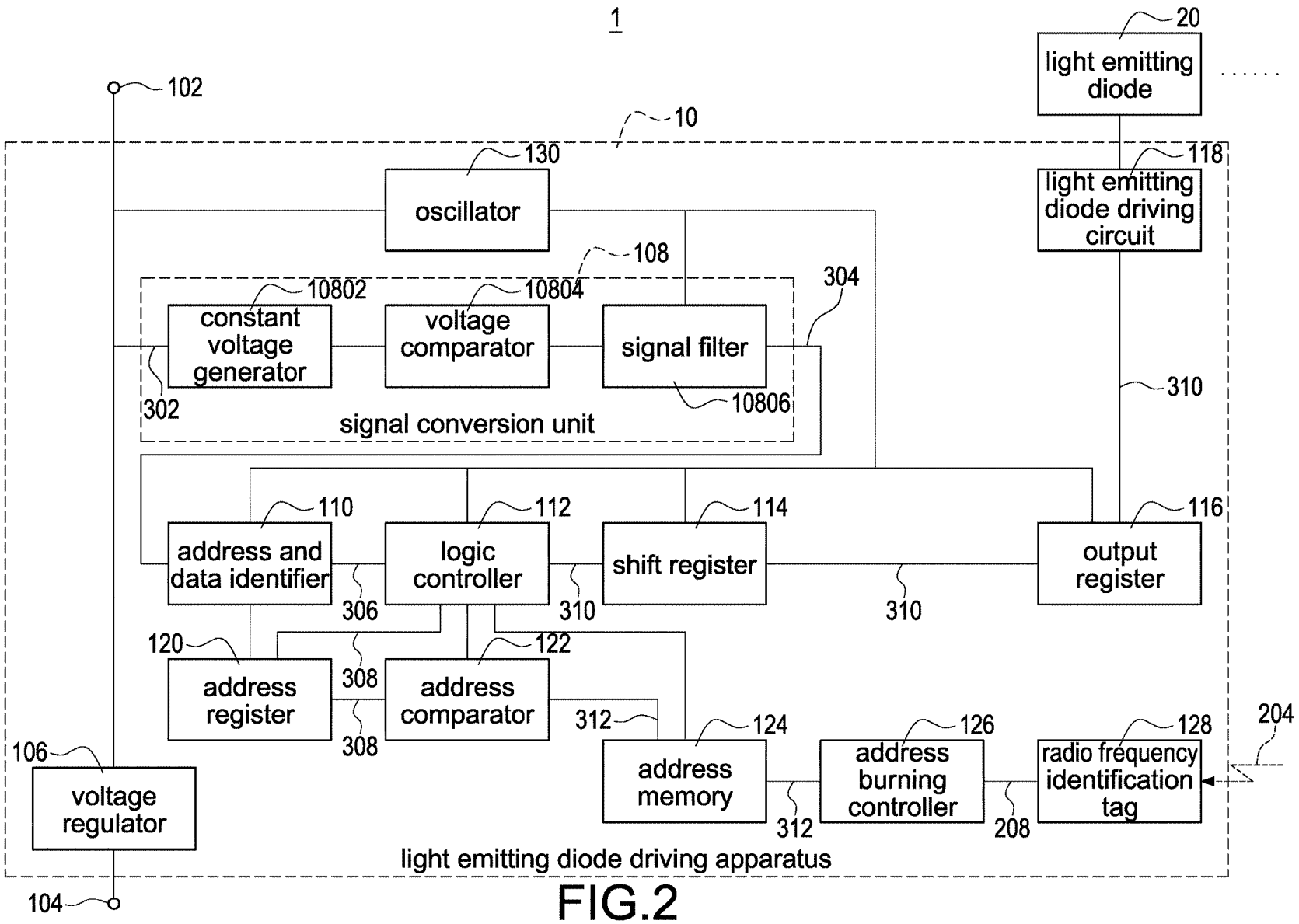
FIG. 2 shows a block diagram of the second embodiment of the light emitting diode lamp utilizing the radio frequency identification signal of the present invention.

FIG. 2 shows a block diagram of the second embodiment of the light emitting diode lamp utilizing the radio frequency identification signal of the present invention. The descriptions of the elements shown in FIG. 2 which are the same as the elements shown in FIG. 1 are not repeated here for brevity. Moreover, the light emitting diode lamp 1 further comprises a first contact 102 and a second contact 104. The light emitting diode driving apparatus 10 further comprises a signal conversion unit 108, an address and data identifier 110, a logic controller 112, a shift register 114, an output register 116, an address register 120, an address comparator 122, a voltage regulator 106 and an oscillator 130. The signal conversion unit 108 comprises a constant voltage generator 10802, a voltage comparator 10804 and a signal filter 10806. Moreover, the voltage comparator 10804 can be replaced by a voltage subtractor.

The signal conversion unit 108 is electrically connected to the first contact 102. The address and data identifier 110 are electrically connected to the signal conversion unit 108. The logic controller 112 is electrically connected to the address and data identifier 110 and the address memory 124. The shift register 114 is electrically connected to the logic controller 112. The output register 116 is electrically connected to the shift register 114 and the light emitting diode driving circuit 118. The address register 120 is electrically connected to the address and data identifier 110 and the logic controller 112. The address comparator 122 is electrically connected to the logic controller 112, the address register 120 and the address memory 124. The voltage regulator 106 is electrically connected to the first contact 102, the second contact 104 and the signal conversion unit 108. The oscillator 130 is electrically connected to the first contact 102, the voltage regulator 106, the signal conversion unit 108, the address and data identifier 110, the logic controller 112, the shift register 114 and the output register 116. The constant voltage generator 10802 is electrically connected to the first contact 102. The voltage comparator 10804 is electrically connected to the constant voltage generator 10802. The signal filter 10806 is electrically connected to the voltage comparator 10804 and the address and data identifier 110.

The signal conversion unit 108 is configured to receive a first signal 302 through the first contact 102. The signal conversion unit 108 is configured to convert the first signal 302 into a second signal 304 and is configured to send the second signal 304 to the address and data identifier 110. The address and data identifier 110 are configured to identify the second signal 304 to obtain a third signal 306. The third signal 306 comprises an address data 308 and a lighting data 310. The address and data identifier 110 are configured to send the third signal 306 to the logic controller 112. The logic controller 112 is configured to send the address data 308 to the address register 120. The address register 120 is configured to store the address data 308. The address comparator 122 is configured to compare the address data 308 stored in the address register 120 with the local address data 312 stored in the address memory 124. Moreover, the first signal 302 is composed of (namely, comprises) a series of pulse waves.

If the address data 308 stored in the address register 120 is the same with the local address data 312 stored in the address memory 124, the address comparator 122 is configured to inform the logic controller 112 that the address data 308 stored in the address register 120 is the same with the local address data 312 stored in the address memory 124, so that the logic controller 112 is configured to send the lighting data 310 to the light emitting diode driving circuit 118 through the shift register 114 and the output register 116. The light emitting diode driving circuit 118 is configured to drive the at least one light emitting diode 20 to light based on the lighting data 310. Moreover, the first signal 302 is a wired signal. Moreover, FIG. 2 shows that the present invention is in a normal state to receive power, and the present invention receives the first signal 302 through the first contact 102 to change a lighting mode of the at least one light emitting diode 20 when the present invention needs to change the lighting mode of the at least one light emitting diode 20.

Figure 3:
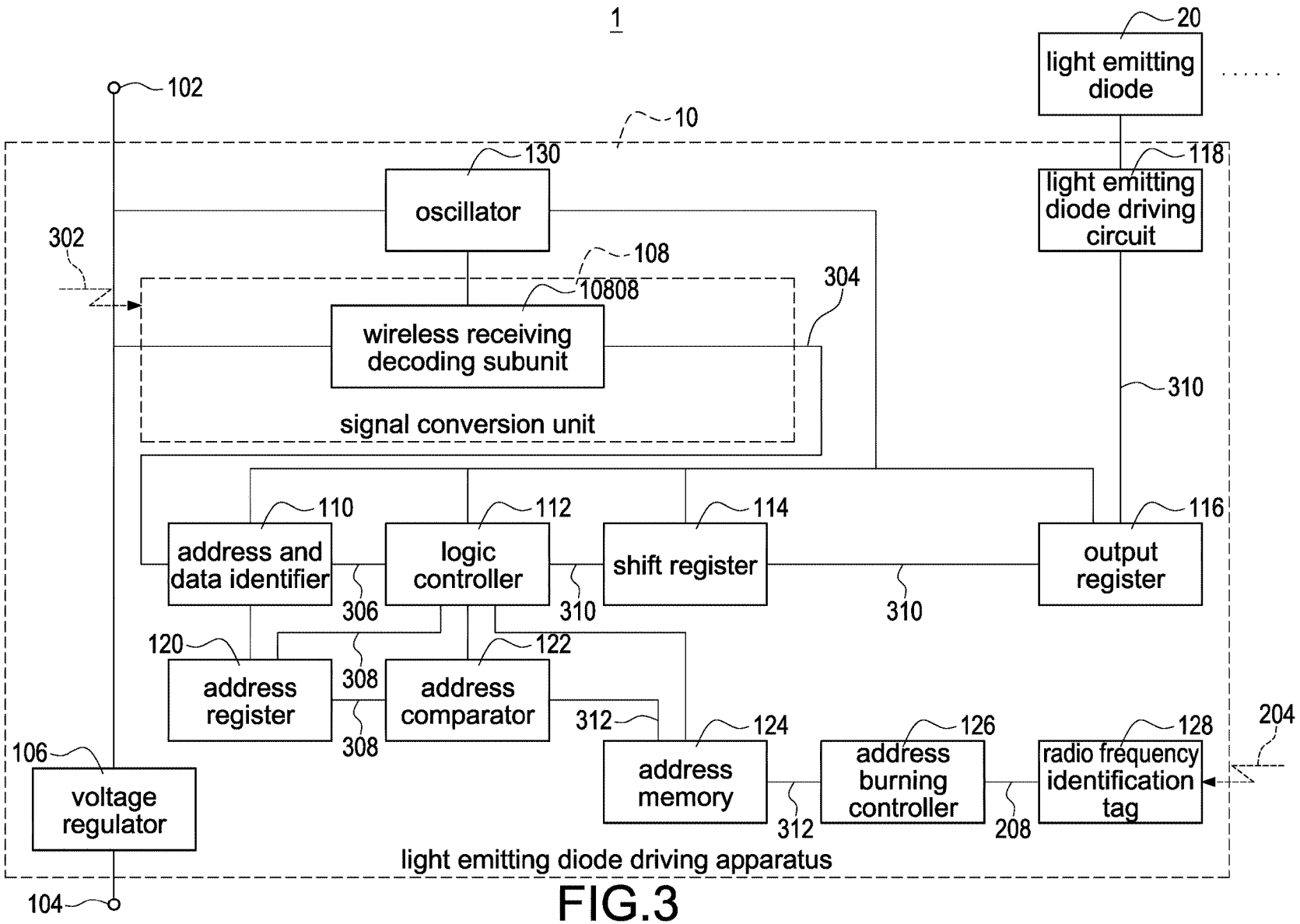
FIG. 3 shows a block diagram of the third embodiment of the light emitting diode lamp utilizing the radio frequency identification signal of the present invention.

FIG. 3 shows a block diagram of the third embodiment of the light emitting diode lamp utilizing the radio frequency identification signal of the present invention. The descriptions of the elements shown in FIG. 3 which are the same as the elements shown in FIG. 2 are not repeated here for brevity. Moreover, the signal conversion unit 108 comprises a wireless receiving decoding subunit 10808. The wireless receiving decoding subunit 10808 is electrically connected to the first contact 102 and the address and data identifier 110. Moreover, the first signal 302 is a wireless signal. The wireless receiving decoding subunit 10808 is configured to decode the first signal 302 to obtain the second signal 304. Moreover, FIG. 3 shows that the present invention is in a wireless receiving state that the light emitting diode driving apparatus 10 through the first contact 102 receives only power. The signal conversion unit 108 does not receive the first signal 302 through the first contact 102, but the signal conversion unit 108 wirelessly receives the first signal 302. The wireless receiving decoding subunit 10808 has functions of both receiving the first signal 302 and decoding the first signal 302, and a wireless module (not shown in FIG. 7) of a control box 5 (shown in FIG. 7) is configured to wirelessly send the first signal 302 to the wireless receiving decoding subunit 10808.

Figure 4:
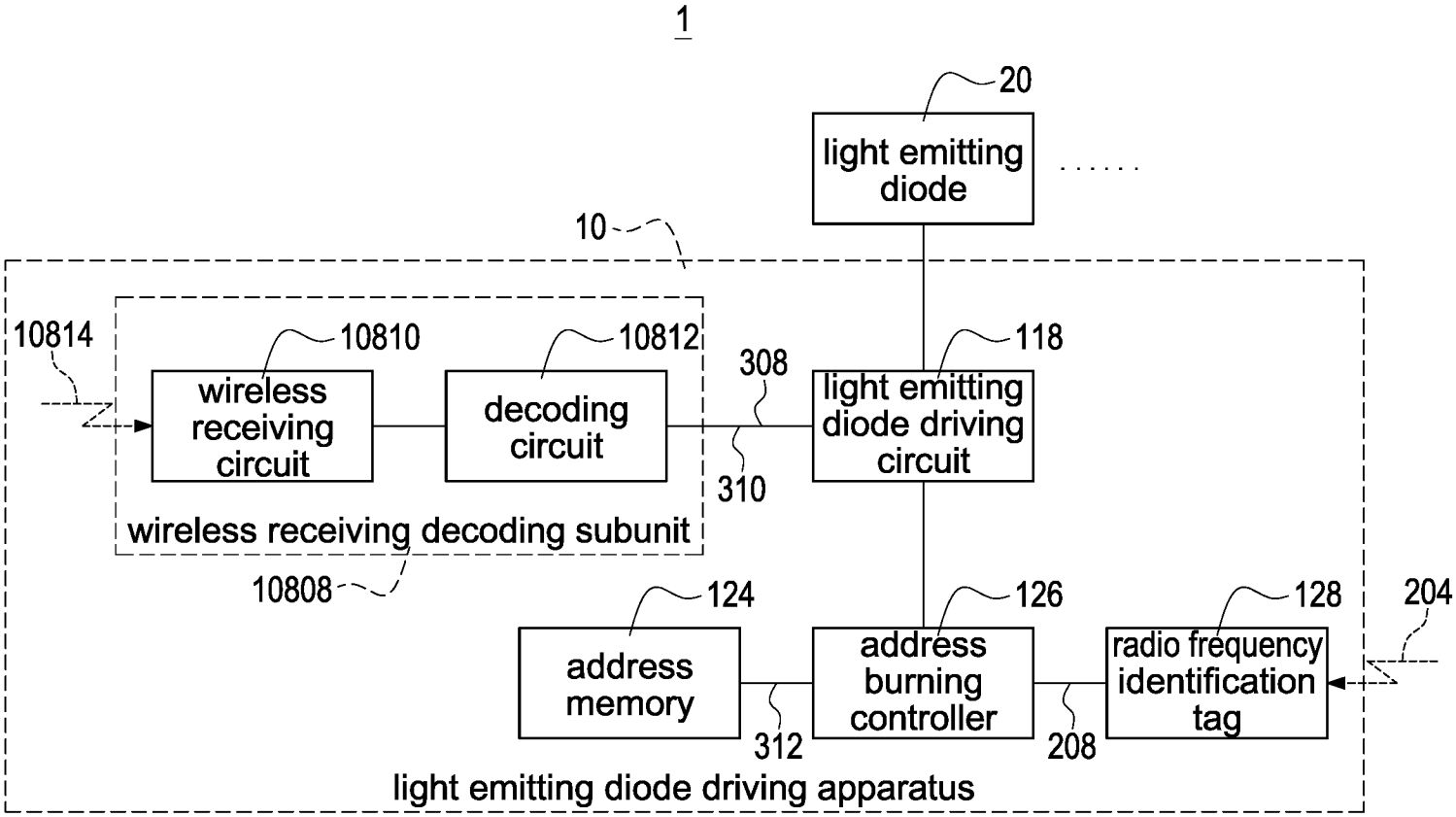
FIG. 4 shows a block diagram of the fourth embodiment of the light emitting diode lamp utilizing the radio frequency identification signal of the present invention.

In another embodiment of the present invention, please refer to FIG. 4. FIG. 4 shows a block diagram of the fourth embodiment of the light emitting diode lamp utilizing the radio frequency identification signal of the present invention. The descriptions of the elements shown in FIG. 4 which are the same as the elements shown in FIG. 1 are not repeated here for brevity. Moreover, the light emitting diode driving apparatus 10 further comprises a wireless receiving decoding subunit 10808. The wireless receiving decoding subunit 10808 comprises a wireless receiving circuit 10810 and a decoding circuit 10812. The wireless receiving decoding subunit 10808 is electrically connected to the light emitting diode driving circuit 118. The decoding circuit 10812 is electrically connected to the light emitting diode driving circuit 118 and the wireless receiving circuit 10810.

The wireless receiving circuit 10810 is configured to wirelessly receive a lighting driving signal 10814, and then the decoding circuit 10812 is configured to decode the lighting driving signal 10814 to obtain an address data 308 and a lighting data 310. The light emitting diode driving circuit 118 is configured to drive the at least one light emitting diode 20 to light based on the lighting data 310 if the address data 308 is the same with the local address data 312 stored in the address memory 124. In FIG. 4, sources of the lighting driving signal 10814 are not limited. The lighting driving signal 10814 is equal to the first signal 302 (namely, wireless signal) if the lighting driving signal 10814 is from the control box 5 (shown in FIG. 7) mentioned above.

FIG. 5 shows a block diagram of the first embodiment of the light emitting diode system utilizing the radio frequency identification signal of the present invention. The descriptions of the elements shown in FIG. 5 which are the same as the elements shown in FIG. 1 are not repeated here for brevity. A light emitting diode system 3 of the present invention comprises the light emitting diode lamp 1 and a radio frequency identification reader/writer 2. The radio frequency identification reader/writer 2 is wirelessly connected to the light emitting diode lamp 1. Moreover, the radio frequency identification reader/writer 2 is configured to wirelessly send the radio frequency identification signal 204 to the radio frequency identification tag 128.

Figure 7:
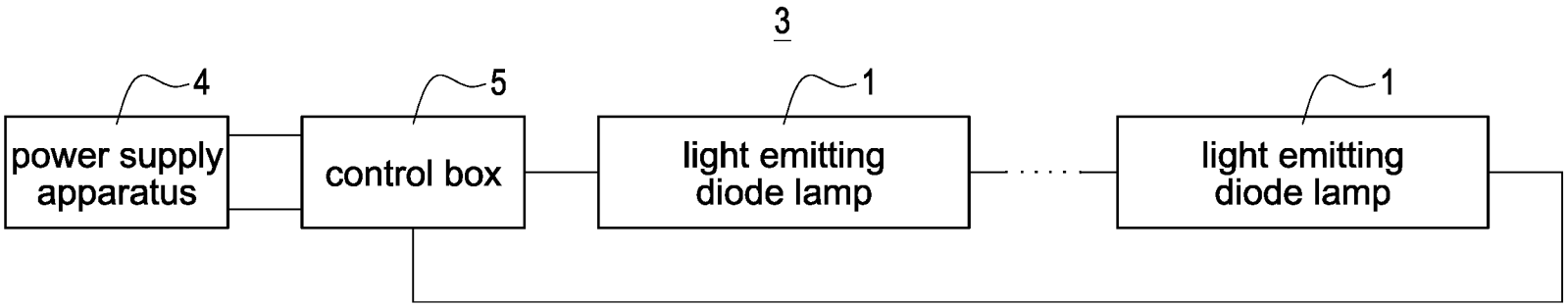
FIG. 7 shows a block diagram of the second embodiment of the light emitting diode system utilizing the radio frequency identification signal of the present invention.

FIG. 7 shows a block diagram of the second embodiment of the light emitting diode system utilizing the radio frequency identification signal of the present invention. The descriptions of the elements shown in FIG. 7 which are the same as the elements shown in figures mentioned above are not repeated here for brevity. A light emitting diode system 3 of the present invention comprises a plurality of the light emitting diode lamps 1, a power supply apparatus 4 and a control box 5. The components mentioned above are electrically connected to each other. The light emitting diode system 3 is a two-wire power carrier lamp string system. The power supply apparatus 4 is, for example but not limited to, an alternating-current-to-direct-current converter.

The light emitting diode lamps 1 are connected to each other in series through the first contacts 102 and the second contacts 104 shown in the figures mentioned above. In FIG. 7, the first contact 102 (not shown in FIG. 7 but shown in the figures mentioned above; namely, the anode) of the first light emitting diode lamp 1 from left to right is connected to the control box 5. The second contact 104 (not shown in FIG. 7 but shown in the figures mentioned above; namely, the cathode) of the last light emitting diode lamp 1 from left to right is connected to the control box 5.

Figure 6:
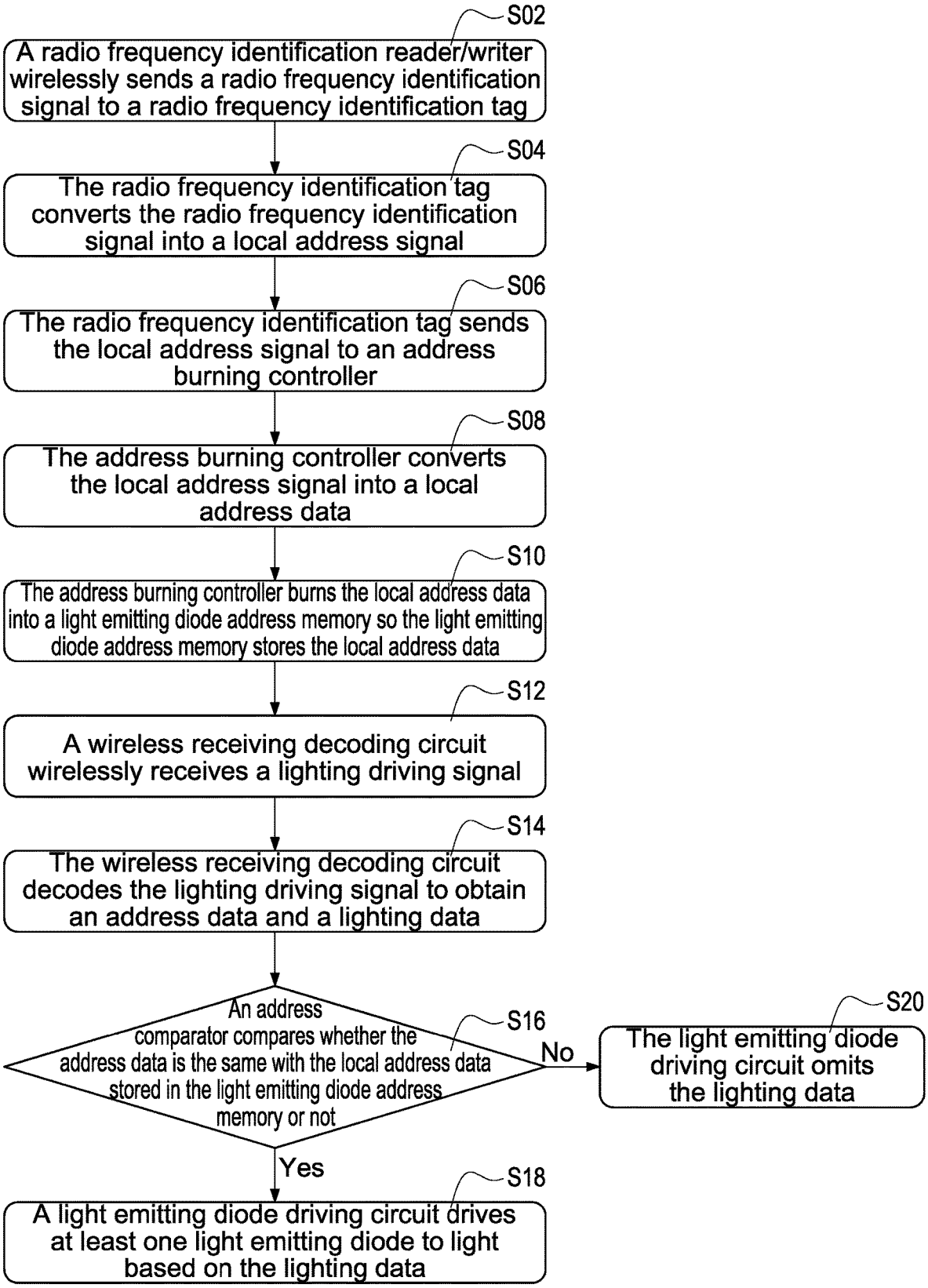
FIG. 6 shows a flow chart of the light emitting diode address burning method utilizing the radio frequency identification signal of the present invention.

FIG. 6 shows a flow chart of the light emitting diode address burning method utilizing the radio frequency identification signal of the present invention. A light emitting diode address burning method of the present invention comprises following steps.

S02: A radio frequency identification reader/writer wirelessly sends a radio frequency identification signal to a radio frequency identification tag. Then the light emitting diode address burning method goes to a step S04.

S04: The radio frequency identification tag converts the radio frequency identification signal into a local address signal. Then the light emitting diode address burning method goes to a step S06.

S06: The radio frequency identification tag sends the local address signal to an address burning controller. Then the light emitting diode address burning method goes to a step S08.

S08: The address burning controller converts the local address signal into a local address data. Then the light emitting diode address burning method goes to a step S10.

S10: The address burning controller burns the local address data into a light emitting diode address memory so the light emitting diode address memory stores the local address data. Then the light emitting diode address burning method goes to a step S12.

S12: A wireless receiving decoding circuit wirelessly receives a lighting driving signal. Then the light emitting diode address burning method goes to a step S14.

S14: The wireless receiving decoding circuit decodes the lighting driving signal to obtain an address data and a lighting data. Then the light emitting diode address burning method goes to a step S16.

S06: An address comparator compares whether the address data is the same with the local address data stored in the light emitting diode address memory or not. If the address data is the same with the local address data stored in the light emitting diode address memory, the light emitting diode address burning method goes to a step S18. If the address data is not the same with the local address data stored in the light emitting diode address memory, the light emitting diode address burning method goes to a step S20.

S18: A light emitting diode driving circuit drives at least one light emitting diode to light based on the lighting data.

S20: The light emitting diode driving circuit omits the lighting data. Then the light emitting diode address burning method waits another new lighting driving signal.

In an embodiment of the present invention, before the step S02, the light emitting diode address burning method further comprises steps that: The radio frequency identification reader/writer sets the local address data in the radio frequency identification signal. The radio frequency identification reader/writer is close to the radio frequency identification tag so the radio frequency identification tag automatically induces the radio frequency identification signal.

In another embodiment of the present invention, in the step S12, the wireless receiving decoding circuit comprises a wireless receiving circuit and a decoding circuit. The wireless receiving circuit wirelessly receives the lighting driving signal. In the step S14, the decoding circuit decodes the lighting driving signal to obtain the address data and the lighting data.

The radio frequency identification tag is a passive radio frequency identification tag. The light emitting diode address memory can be a one-time programmable memory or a multiple-time programmable memory, such as an e-fuse memory, an erasable programmable read only memory, an electrically erasable programmable read only memory or a flash memory.

The advantage of the present invention is to utilize the radio frequency identification technology to easily burn the local address data 312 into the light emitting diode driving apparatus 10 which had been manufactured to store or change the local address data 312 of the light emitting diode driving apparatus 10. Moreover, the light emitting diode driving apparatus 10 can be burned repeatedly. Moreover, the radio frequency identification tag 128 is the passive radio frequency identification tag, so that the present invention can achieve the purpose of saving more power. Moreover, compared to the burning data being sent through the power carriers when burning, the present invention can avoid incorrectly determining the conventional carrier signals as the burning signal. Moreover, both the first signal 302 (in FIG. 3) and the lighting driving signal 10814 (in FIG. 4) are the wireless signals, so that the arrangement of the present invention can be wider, and is not limited by the lengths of the wires.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode lamp comprising:

a light emitting diode driving apparatus;

at least one light emitting diode electrically connected to the light emitting diode driving apparatus; and a first contact, wherein the light emitting diode driving apparatus comprises:

a radio frequency identification tag;

an address burning controller electrically connected to the radio frequency identification tag;

an address memory electrically connected to the address burning controller;

a light emitting diode driving circuit electrically connected to the at least one light emitting diode and the address burning controller;

a signal conversion unit electrically connected to the first contact;

an address and data identifier electrically connected to the signal conversion unit;

a logic controller electrically connected to the address and data identifier and the address memory;

a shift register electrically connected to the logic controller;

an output register electrically connected to the shift register and the light emitting diode driving circuit;

an address register electrically connected to the address and data identifier and the logic controller; and an address comparator electrically connected to the logic controller, the address register and the address memory, wherein the radio frequency identification tag is configured to wirelessly receive a radio frequency identification signal; the radio frequency identification tag is configured to convert the radio frequency identification signal into a local address signal; the radio frequency identification tag is configured to send the local address signal to the address burning controller; the address burning controller is configured to convert the local address signal into a local address data; the address burning controller is configured to burn the local address data into the address memory so the address memory is configured to store the local address data;

wherein the signal conversion unit is configured to receive a first signal through the first contact; the signal conversion unit is configured to convert the first signal into a second signal and is configured to send the second signal to the address and data identifier; the address and data identifier is configured to identify the second signal to obtain a third signal; the third signal comprises an address data and a lighting data; the address and data identifier is configured to send the third signal to the logic controller; the logic controller is configured to send the address data to the address register; the address register is configured to store the address data; the address comparator is configured to compare the address data stored in the address register with the local address data stored in the address memory;

wherein if the address data stored in the address register is the same with the local address data stored in the address memory, the address comparator is configured to inform the logic controller that the address data stored in the address register is the same with the local address data stored in the address memory, so that the logic controller is configured to send the lighting data to the light emitting diode driving circuit through the shift register and the output register; the light emitting diode driving circuit is configured to drive the at least one light emitting diode to light based on the lighting data; and wherein if the address data stored in the address register is not the same with the local address data stored in the address memory, the light emitting diode driving circuit is configured to omit the lighting data.

2. The light emitting diode lamp in claim 1, wherein the radio frequency identification tag is a passive radio frequency identification tag.

3. The light emitting diode lamp in claim 1 further comprising:

a second contact, wherein the light emitting diode driving apparatus further comprises:

a voltage regulator electrically connected to the first contact, the second contact and the signal conversion unit; and an oscillator electrically connected to the first contact, the voltage regulator, the signal conversion unit, the address and data identifier, the logic controller, the shift register and the output register.

4. The light emitting diode lamp in claim 1, wherein the signal conversion unit comprises:

a constant voltage generator electrically connected to the first contact;

a voltage comparator electrically connected to the constant voltage generator; and a signal filter electrically connected to the voltage comparator and the address and data identifier, wherein the first signal is a wired signal.

5. The light emitting diode lamp in claim 1, wherein the signal conversion unit comprises:

a wireless receiving decoding subunit electrically connected to the first contact and the address and data identifier, wherein the first signal is a wireless signal; the wireless receiving decoding subunit is configured to decode the first signal to obtain the second signal.

6. A light emitting diode system comprising:

a light emitting diode lamp; and a radio frequency identification reader/writer electrically connected to the light emitting diode lamp, wherein the light emitting diode lamp comprises:

a light emitting diode driving apparatus;

at least one light emitting diode electrically connected to the light emitting diode driving apparatus; and a first contact, wherein the light emitting diode driving apparatus comprises:

a radio frequency identification tag;

an address burning controller electrically connected to the radio frequency identification tag;

an address memory electrically connected to the address burning controller;

a light emitting diode driving circuit electrically connected to the at least one light emitting diode and the address burning controller, a signal conversion unit electrically connected to the first contact;

an address and data identifier electrically connected to the signal conversion unit;

a logic controller electrically connected to the address and data identifier and the address memory;

a shift register electrically connected to the logic controller;

an output register electrically connected to the shift register and the light emitting diode driving circuit;

an address register electrically connected to the address and data identifier and the logic controller; and an address comparator electrically connected to the logic controller, the address register and the address memory, wherein the radio frequency identification tag is configured to wirelessly receive a radio frequency identification signal; the radio frequency identification tag is configured to convert the radio frequency identification signal into a local address signal; the radio frequency identification tag is configured to send the local address signal to the address burning controller; the address burning controller is configured to convert the local address signal into a local address data; the address burning controller is configured to burn the local address data into the address memory so the address memory is configured to store the local address data;

wherein the radio frequency identification reader/writer is configured to wirelessly send the radio frequency identification signal to the radio frequency identification tag, wherein the signal conversion unit is configured to receive a first signal through the first contact; the signal conversion unit is configured to convert the first signal into a second signal and is configured to send the second signal to the address and data identifier; the address and data identifier is configured to identify the second signal to obtain a third signal; the third signal comprises an address data and a lighting data; the address and data identifier is configured to send the third signal to the logic controller; the logic controller is configured to send the address data to the address register; the address register is configured to store the address data; the address comparator is configured to compare the address data stored in the address register with the local address data stored in the address memory;

wherein if the address data stored in the address register is the same with the local address data stored in the address memory, the address comparator is configured to inform the logic controller that the address data stored in the address register is the same with the local address data stored in the address memory, so that the logic controller is configured to send the lighting data to the light emitting diode driving circuit through the shift register and the output register; the light emitting diode driving circuit is configured to drive the at least one light emitting diode to light based on the lighting data; and wherein if the address data stored in the address register is not the same with the local address data stored in the address memory, the light emitting diode driving circuit is configured to omit the lighting data.

7. The light emitting diode system in claim 6, wherein the radio frequency identification tag is a passive radio frequency identification tag.

8. A light emitting diode address burning method comprising:

sending a radio frequency identification signal wirelessly to a radio frequency identification tag by a radio frequency identification reader/writer;

converting the radio frequency identification signal into a local address signal by the radio frequency identification tag;

sending the local address signal to an address burning controller by the radio frequency identification tag;

converting the local address signal into a local address data by the address burning controller;

burning the local address data into a light emitting diode address memory by the address burning controller;

storing the local address data by the light emitting diode address memory;

receiving a lighting driving signal wirelessly by a wireless receiving decoding circuit;

obtaining an address data and a lighting data by the wireless receiving decoding circuit decoding the lighting driving signal;

comparing the address data with the local address data stored in the light emitting diode address memory by an address comparator; and driving at least one light emitting diode to light by a light emitting diode driving circuit based on the lighting data if the address data is the same with the local address data stored in the light emitting diode address memory, wherein if the address data is not the same with the local address data stored in the light emitting diode address memory, the light emitting diode driving circuit is configured to omit the lighting data.

9. The light emitting diode address burning method in claim 8, wherein the radio frequency identification tag is a passive radio frequency identification tag.

* * * * *